United States Patent [19]

Guidara

[11] 3,954,155

[45] May 4, 1976

[54] STEPLADDER DOLLY

[76] Inventor: Orlando Guidara, 79 Livingstone Ave., Beverly, Mass. 01915

[22] Filed: Apr. 23, 1974

[21] Appl. No.: 463,402

[52] U.S. Cl. ..... 182/20; 280/30

[51] Int. Cl.[2] ..... E06C 1/397

[58] Field of Search ..... 182/16, 20, 21, 28, 182/29, 30, 31; 280/30

[56] References Cited

UNITED STATES PATENTS

| | | | |
|---|---|---|---|
| 680,402 | 8/1901 | Court | 182/20 |
| 867,754 | 10/1907 | Randall | 280/30 |
| 1,116,779 | 11/1914 | Witt | 182/16 |
| 1,423,366 | 7/1922 | Snook | 182/16 |
| 2,834,526 | 5/1958 | Paris | 182/16 |
| 2,922,487 | 1/1960 | Reitknecht | 182/16 |
| 3,104,889 | 9/1963 | Branch | 182/20 |

*Primary Examiner*—Reinaldo P. Machado

[57] ABSTRACT

A stepladder with a sturdy plate mounted on its top surface and a pair of wheels mounted near the top of the ladder is provided so that upon folding the legs together and inverting the ladder, it becomes a dolly which rides on said wheels and employs the plate as a carry plate. Additional wheels or casters are added to the other end of the ladder to convert same to a wheeled flat bed.

9 Claims, 3 Drawing Figures

STEPLADDER DOLLY

FIELD OF THE INVENTION

This invention relates to a stepladder, particularly a stepladder which converts to a wheeled dolly.

THE PRIOR ART

Due to the widespread uses of both stepladders and dollies, in business and in the home, it is considered highly desireable to have a stepladder which converts to a dolly and vice-versa, with the advantages such dual purpose tool brings. Attempts have been made to produce such a tool, U.S. Pat. Nos. 1,116,779 to Witt, 2,834,526 to Paris, 2,980,200 to Kibby and 3,104,889 to Branch. However, these stepladder dollies have all had in common the positioning of the dolly wheels at or near the base of the stepladder with the resultant difficulties in stability thereof or in moving the wheels and connecting axle out of the way to prevent rolling thereof or in having to step over the wheels and axle in mounting the ladder. Thus, all the ladders of these references have had problems with what to do with the dolly and wheels when the tool is used as a stepladder which bears on the question of safety for such tools.

There is, therefore, a need and market for a dual purpose stepladder dolly which substantially overcomes the above shortcomings.

There has now been developed a stepladder dolly wherein the dolly wheels are moved well away from the floor and away from the tread of the user when the dual purpose tool is used as a stepladder.

Broadly, the present invention provides a convertible stepladder dolly comprising a stepladder having a pair of legs, cross members connecting said legs, at least some of which define steps, a support member pivotably connected thereto to support said legs in an inclined position, the uppermost cross member thereof extending forward of said ladder in a durable carrying plate, a first roller means mounted to the top portion of said stepladder and extending behind said carrying plate and said legs, a second roller means mounted to the bottom portion of said stepladder and extending behind said legs such that said stepladder on being inverted becomes a dolly with said plate defining the forward projecting carry plate thereof, which dolly rides at least on said first roller means.

The invention will become more apparent from the following detailed description and drawings in which.

Figure 1:
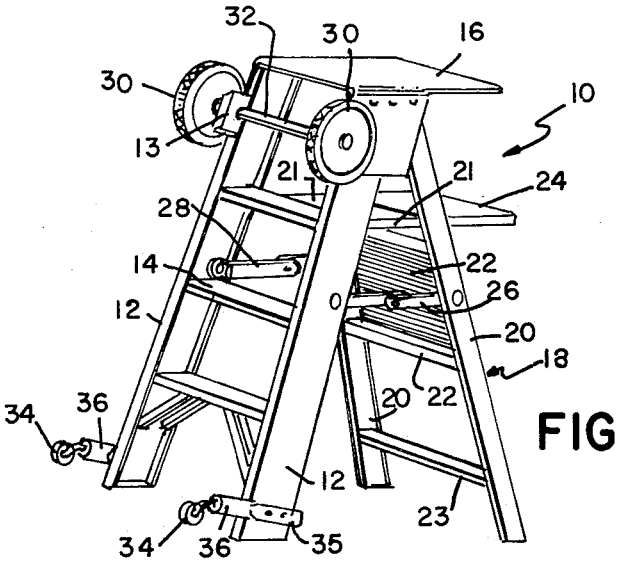
FIG. 1 is an isometric projection of the stepladder dolly embodying the present invention.

Referring now to the drawings, stepladder dolly 10 has legs 12 joined by cross member steps 14 and uppermost cross member, carry plate 16, which ladder is held upright by support member 18 having legs 20 joined by bracing plate 22, brace bar 23 and pivotable tray 24, (which hinges on plate 22 on arms 21), which support member 18 is pivotably joined to carry plate 16 and connected to ladder legs 12 by foldable arms 26 and 28, as shown in FIG. 1. Rotatably mounted to legs 12, on leg extensions 13, are dolly wheels 30, connected by axle 32, as first roller means and, as second roller means, mounted at the other end of legs 12, are a pair of caster wheels 34, mounted on extension leg handles 36, which connect to the ladder legs 12 as shown in FIG. 1.

Figure 2:
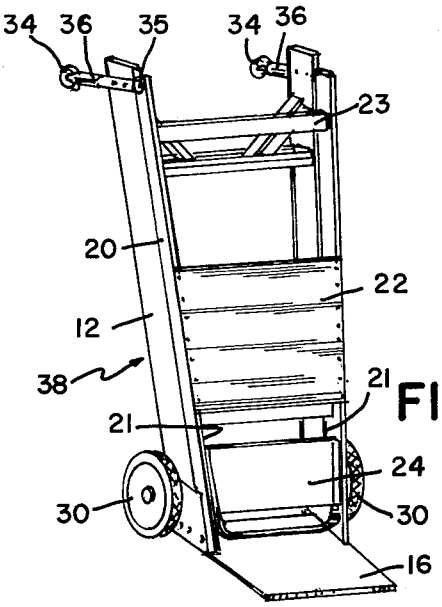
FIG. 2 is an isometric projection of the stepladder dolly embodiment of FIG. 1 in an inverted position.

The stepladder is converted to a dolly by closing the legs 20 against legs 12 and inverting the same to form dolly 38 having dolly wheels 30, carry plate 16 and additional reinforcing carry plates 22 and 24 and handles 36 as shown in FIG. 2. The extension leg handles 36 are secured in leg mountings 34 which extend beyond the ladder legs 12 to clamp the support legs 20 therebetween and secure same when the respective legs 12 and 20 are folded together.

Figure 3:
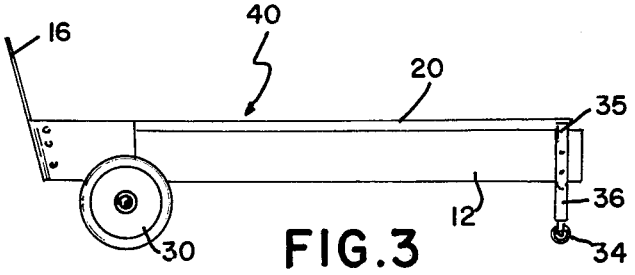
FIG. 3 is a side elevation view of the stepladder dolly embodiment of FIG. 1 in another inverted position.

Further, the dolly can be lowered to all four wheels 30 and 34 and serve as a wheeled flat bed 40, which has as carrying surfaces, plates 24 and 22 and cross brace 23, (all as shown in FIG. 2), and support legs 20 to carry objects thereon as shown in FIG. 3. The casters 34 provide manueverability to such flat bed and facilitate turning thereof.

Thus, it can be seen that the stepladder dolly embodying the present invention is readily changed from a stepladder to a dolly and/or flat bed and vice-versa. While the stepladder dollies of the prior art are convertible, the stepladder dolly of the present invention is invertible (as well as convertible). Thus, when the dolly of the invention is changed to a stepladder, by inverting the same, the dolly wheels 30 are moved remote from the floor or other surface and well out of the way of the person ascending the ladder, i.e. above the treads, making the use of same much safer than those of the prior art. In addition, the dolly wheels 30 and its axle can be removed entirely while the invention is employed as a stepladder, where desired.

Additionally, when the invention is employed as a stepladder, the carry plate 16 is used as an extra large work or support surface and when the stepladder is inverted, the support carry plate 16 is employed as the main carry plate of the dolly, (FIG. 2).

The stepladder dolly embodying the present invention is useful in home and business and industry, indoors and outdoors, e.g., for picking apples and then carting bushels of same away on the dolly.

The stepladder dolly of the present invention, has a rigid frame of metal or wood or plastic, preferably, metal, e.g. steel.

Each roller means of the stepladder dolly can be a plurality of wheels or casters as desired. The main load bearing dolly wheels number two or more and are preferably, but not necessarily, connected by an axle. The second roller means can be at least one caster or wheel or a plurality thereof. Where there are at least two such casters or wheels, preferably there is no axle connecting same, since such axle would interfere with the access to the stepladder. However, such axle can be employed, if desired and it is recommended that such axle be placed close to the legs of the stepladder. Where a plurality of or a pair of casters are employed as the second roller means on the invention, preferably these casters are mounted on legs as illustrated in FIGS. 1 and 3 so that the flat bed will be level as illustrated in FIG. 3. These caster legs serve the additional advantage of providing handle grips for the dolly aspect of the invention, as illustrated, for example, in FIG. 2. Such dolly leg handles can be straight, curved or otherwise contoured to provide a sure grip on either side.

The tray 24 and support plate 22, illustrated in FIGS. 1 and 2, are optional components of the stepladder dolly of the invention and though not necessary, are desireable. Where the tray 24 is employed, it is desireable that the tray be pivotably mounted and swing out of the way and serve as additional support means in the dolly aspect of the invention, as illustrated for examples in FIGS. 2 and 3.

What is claimed is:

1. An invertable stepladder dolly comprising a stepladder having a pair of legs, cross members connecting said legs, at least some of which define steps, a support member pivotably connected thereto to support said legs in an inclined position, the uppermost cross member extending forward of said ladder in a durable carry plate; a first roller means mounted to the top portion of said stepladder and extending behind said carry plate and said legs, a second roller means mounted to the bottom portion of said stepladder and extending behind said legs such that said stepladder on being inverted becomes a dolly with said plate defining the forward projecting carry plate thereof, and extending past the plane of said support member which dolly rides at least on said first roller means.

2. The stepladder dolly of claim 1 wherein the first roller means is a pair of wheels connected by an axle and mounted on the rear side of said legs at the upper portion of said stepladder and said second roller means is a pair of spaced wheels mounted on the rear side of said legs at the lower portion of said stepladder.

3. The stepladder dolly of claim 1 wherein said support member is a pair of support legs which fold against the ladder legs to define a carry surface for said dolly.

4. The stepladder dolly of claim 3 wherein said support legs have mounted therebetween a support plate in longitudinal alignment therewith.

5. The stepladder dolly of claim 1 wherein said second roller means is a pair of spaced casters mounted on legs extending from the rear side of said legs, which legs become dolly handles when said step ladder is inverted and become caster legs when said dolly is lowered to ride on all wheels as a flat bed.

6. The stepladder dolly of claim 1 wherein said first roller means is a plurality of wheels and said second roller means is at least one wheel.

7. The stepladder dolly of claim 6 wherein all of said wheels are mounted on extension arms.

8. The stepladder dolly of claim 5 wherein the caster legs extend past the forward side of said ladder legs to grip said support member therebetween when the same is folded against said ladder legs.

9. An invertable stepladder dolly comprising a stepladder having a pair of legs, cross members connecting said legs, at least some of which define steps, a support member pivotably connected thereto to support said legs in an inclined position, the uppermost cross member extending forward of said ladder in a durable carry plate, a roller means mounted to the top portion of said stepladder and extending behind said carry plate and said legs such that said stepladder, on being inverted, becomes a dolly with said plate defining the forward projecting carry plate thereof and extending past the plane of said support member, which dolly rides on said roller means.

* * * * *